US006164229A

United States Patent [19]

Cavanagh

[11] Patent Number: 6,164,229

[45] Date of Patent: Dec. 26, 2000

[54] AIR BEARING PONTOON SYSTEM FOR SHIPPING CONTAINERS

[75] Inventor: Richard A. Cavanagh, Panama City, Fla.

[73] Assignee: The United States of America as represented by the Secretary of the Navy, Washington, D.C.

[21] Appl. No.: 09/332,250

[22] Filed: May 27, 1999

[51] Int. Cl.[7] ..... B63B 1/00

[52] U.S. Cl. ..... 114/61.1; 114/67 A; 180/121; 180/125

[58] Field of Search ..... 114/67 A, 67 R, 114/61.1, 123, 292, 61.14; 180/121, 125; 414/676

[56] References Cited

U.S. PATENT DOCUMENTS

| | | | |
|---|---|---|---|
| 3,106,260 | 10/1963 | Bollum | 114/67 A |
| 3,662,853 | 5/1972 | Love | 180/121 |
| 3,791,535 | 2/1974 | Baker et al. | 180/125 |
| 4,067,516 | 1/1978 | Dobb | 114/67 A |
| 4,843,969 | 7/1989 | Chaffee et al. | 180/121 |
| 5,722,341 | 3/1998 | Tornqvist | 114/67 A |

*Primary Examiner*—Stephen Avila
*Attorney, Agent, or Firm*—Harvey A. Gilbert; Donald G. Peck

[57] ABSTRACT

A system for facilitating movement of a shipping container uses a plurality of air bearing pontoons interposed between a shipping container and a hard, soft or water surface. Each air bearing pontoon includes an inflatable skirt and its own controllable air supply that allows the skirt to float on a cushion of air above the surface.

19 Claims, 2 Drawing Sheets

AIR BEARING PONTOON SYSTEM FOR SHIPPING CONTAINERS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to maneuvering large containers, and more particularly to an air bearing pontoon system for facilitating the movement of shipping containers.

BACKGROUND OF THE INVENTION

Large shipping containers meeting ISO standards can be made to any dimensional specification with standard containers typically being 8 feet high and wide by 10, 20 or 40 feet in length. These shipping containers are used in both commercial and military applications. When these containers must be maneuvered on solid terrain or surfaces (e.g., land, wharf, warehouse, etc.), heavy-duty forklifts or cranes are typically used. However, space and/or equipment limitations can made it difficult or impossible to maneuver the containers. Further, there are applications requiring movement of the containers on soft surfaces (e.g., muddy ground, swamps, etc.) or water surfaces such as a beachfront. Obviously, forklifts and cranes are of no use on soft or water surfaces.

SUMMARY OF THE INVENTION

Accordingly, it is an object of the present invention to provide a system that facilitates the movement of large shipping containers.

Another object of the present invention is to provide a system that facilitates the movement of large shipping containers over solid, soft and/or water surfaces.

Other objects and advantages of the present invention will become more obvious hereinafter in the specification and drawings.

In accordance with the present invention, a system for facilitating movement of a shipping container uses a plurality of air bearing pontoons interposed between a shipping container and a surface. Each air bearing pontoon includes an inflatable skirt and a controllable air supply coupled to the inflatable skirt for controlling air pressure within the skirt. The inflatable skirt floats on a cushion of air above the surface. Coupling of each air bearing pontoon to a shipping container is facilitated by the use of a plurality of fittings which can be standardized ISO fittings integrated into or mounted onto the lower corners of the shipping container. The fitting has three sides with a first side forming a base positioned at the bottom of the shipping container. Second and third sides of the fitting extend perpendicularly up from the first side with the second and third sides being joined to one another to form a 90° angle therebetween. Each side of the fitting is provided with a receptacle. In each configuration of the system, the air bearing pontoons are coupled to a shipping container by plugging in to the fittings' receptacles.

DETAILED DESCRIPTION OF THE INVENTION

Figure 1:
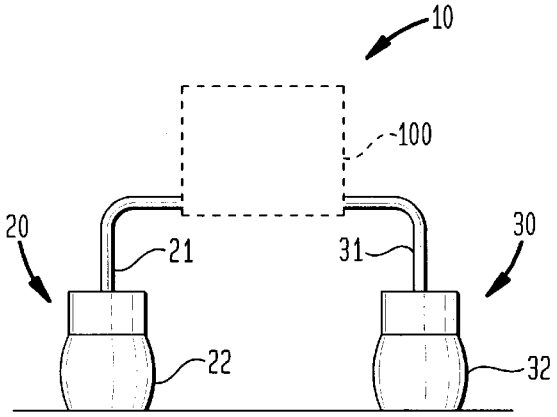
FIG. 1 is an end view of one embodiment of an air bearing pontoon system coupled to a shipping container according to the present invention.

Referring now to the drawings, and more particularly to FIG. 1, an embodiment of the air bearing pontoon system according to the present invention is illustrated and referenced generally by numeral 10. Air bearing pontoon system 10 is shown coupled to large shipping container (e.g., an ISO shipping container) 100 which is illustrated in dashed line form. More specifically, system 10 includes two self-contained, air bearing pontoons 20 and 30 disposed parallel to one another on either side of shipping container 100, i.e., outside the footprint of shipping container 100 as illustrated. Each of air bearing pontoons 20 and 30 is coupled to shipping container 100 along its long sides using frame extensions or arms 21 and 31, respectively. Each of air bearing pontoons 20 and 30 includes an inflatable skirt 22 and 32, respectively, that will float or hover on an air cushion just over a surface 200 (e.g., solid, soft or water surface) when properly inflated. The designs of such inflatable skirts are well understood in the hovercraft and other air lifting device arts, and will therefore not be discussed herein in detail. Each of air bearing pontoons 20 and 30 also includes a controllable air supply (not shown in FIG. 1) for controlling the pressurization of respective skirts 22 and 32 as will be explained further below.

The embodiment illustrated in FIG. 1 is well-suited to maneuvering a shipping container over unstable, uneven or water terrains owing to the fact that pontoons 20 and 30 are positioned outside the footprint of shipping container 100. However, when the terrain is solid and substantially even, or space for maneuvering is limited, the air bearing pontoons can be positioned underneath shipping container 100 as illustrated in the embodiment in FIG. 2. More specifically, air bearing pontoons 40 and 50 are disposed parallel to one another along the length of and underneath shipping container 100 such that pontoons 40 and 50 fall within the footprint of shipping container 100. As in the previous embodiment, each of air bearing pontoons 40 and 50 includes an inflatable skirt 42 and 52, respectively, which generate an air cushion between itself and surface 200 when properly inflated. Further, each of air bearing pontoons 40 and 50 includes a controllable air supply (not shown in FIG. 2) for controlling the pressurization of respective skirts 42 and 52 as will be explained further below.

Figure 3:
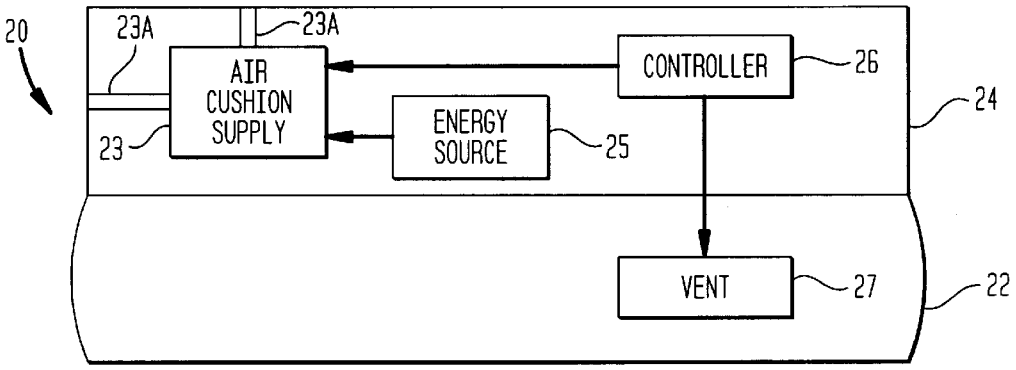
FIG. 3 is a side view of one air bearing pontoon illustrating in block diagram form the controllable air supply used inflate and control the air pressure in the pontoon's inflatable skirt.

Referring now to FIG. 3, the onboard controllable air supply for each air bearing pontoon will be explained by way of example for air bearing pontoon 20. It is to be understood that similar controllable air supplies are provided on each such air bearing pontoon used in the present invention. The controllable air supply includes an air cushion supply 23 for supplying pressurized air to skirt 22. Supply 23 can be mounted in a housing 24 from which skirt 22 depends. Supply 23 can be a motor, engine, fan, etc., having air inlets 23A on the top and/or sides of housing 24. If energy is required to run supply 23, an energy source 25 (e.g., fuel storage tank, power supply, etc.) can also be supplied in housing 24 as necessary. Operation of supply 23 is controlled by a controller 26. A vent 27 can also be provided in skirt 22 and is controlled by controller 26. In operation, controller 26 dictates the amount of pressure maintained in skirt 23 by controlling both supply 23 (e.g., by adjusting fan speed) and vent 27 (e.g., emergency stopping by dumping large volumes of air or maneuvering by allowing the escaping air to serve as directional propulsion). For example, air pressure in skirt 22 can be reduced (relative to skirt 32) so that friction forces will have a greater effect on skirt 22. In this way, the present invention can be used to maneuver (i.e., pivot or steer) shipping container 100.

Figure 4:
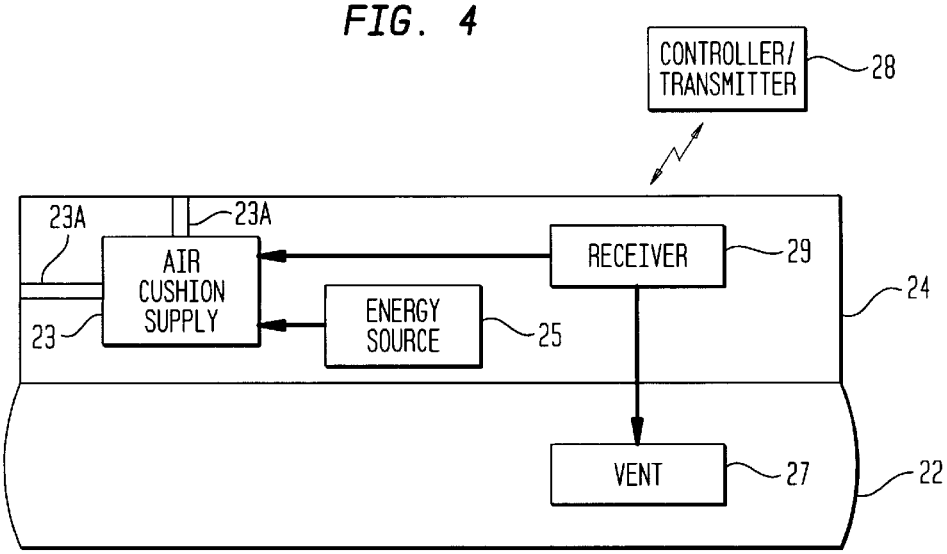
FIG. 4 is a side view of another embodiment of the air bearing pontoon illustrating in block diagram form a remotely controllable air supply.

Control of supply 23 and vent 27 can also be accomplished remotely. For example, as illustrated in FIG. 4, control of air cushion supply 23 and vent 27 is accomplished by the combination of a remotely-located controller/transmitter 28 and a receiver 29 located onboard air bearing pontoon 20. Controller/transmitter 28 can be located at or on some fixed central platform (e.g., a raised platform over a wharf or warehouse floor) or a mobile platform (e.g., ship, aircraft, etc.) for issuing control commands over the airwaves to receiver 29 for distribution to supply 23 and vent 27.

Figure 2:
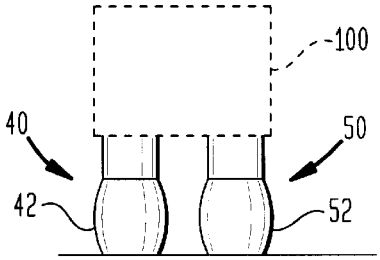
FIG. 2 is an end view of another embodiment of the air bearing pontoon system coupled to a shipping container.
Figure 5:
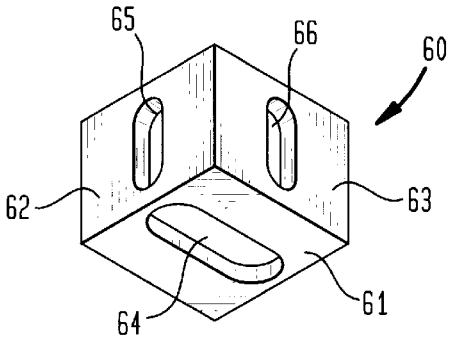
FIG. 5 is a perspective view of the standardized ISO fitting mounted to the lower corners of the shipping container in accordance with the present invention.

Coupling of each air bearing pontoon in either the FIG. 1 or FIG. 2 embodiment is facilitated through the use of fittings attached to or integrated with each lower corner of the shipping container. By way of example, an ISO standardized fitting is illustrated in FIG. 5 and is referenced generally by numeral 60. However, it is to be understood that other types of (mounting) fittings can be used without departing from the scope of the present invention.

Figure 6:
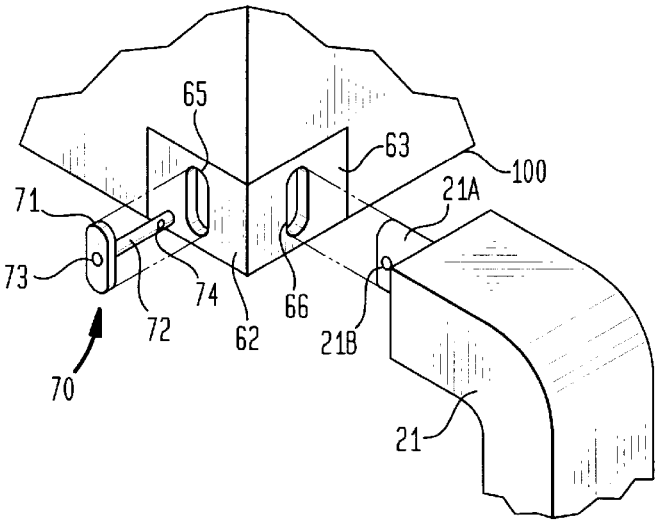
FIG. 6 is a partial view of one of the coupling arms used in the FIG. 1 embodiment illustrating the plug portion thereof that cooperates with the fittings mounted on the lower corners of the shipping container.

Fitting 60 is a three-sided fitting having a base 61 and sides 62 and 63 extending from base 61. More specifically, sides 62 and 63 are perpendicular to one another and to base 61 so that fitting 60 can fit and mount onto, or be integrated into, a lower corner of the shipping container. Each of base 61 and sides 62 and 63 has a port or receptacle 64, 65 and 66, respectively, of standard dimensions formed therein. Receptacles 64, 65 and 66 provide access to a common volume defined by base 61 and sides 62/63. The receptacles facilitate coupling of an air bearing pontoon to the shipping container. For example, in terms of the FIG. 1 embodiment, an arm 21 of air bearing pontoon 20 (illustrated in FIG. 6) can include a plug 21A that fits into receptacle 66. A lock pin 70 is provided to securely mate with receptacle 65 and a hole 21B in plug 21A. Lock pin 70 can be a pip pin device having a housing 71 configured to mate with receptacle 65, and a pin portion 72 extending from housing 71. A button 73 on housing 71 causes a ball bearing 74 to retract into pin portion 72 so that pin portion 72 can be inserted in and removed from hole 21B. When lock pin 70 is positioned with housing 71 in receptacle 65 and pin portion 72 in hole 21B, arm 21 is rigidly coupled to fitting 60 and, therefore, to a lower corner of shipping container 100. Each air bearing pontoon would typically be coupled to front and back fittings 60 located on the same (long) side of shipping container 100.

Figure 7:
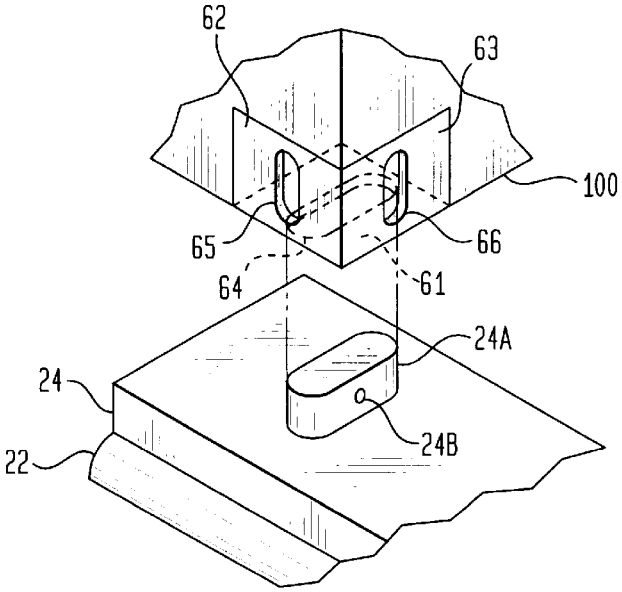
FIG. 7 is a partial view of the top of an air bearing pontoon's housing used in the FIG. 2 embodiment illustrating the plug that cooperates with the underside of the fittings mounted on the lower corners of the shipping container.

In terms of the FIG. 2 embodiment, a plug 24A could be provided or integrated into the top of housing 24 as illustrated in FIG. 7. Typically, plug 24A would be provided on the fore and aft portion of housing 24 to cooperate with fore and aft fittings 60 on shipping container 100. Each plug 24A fits into receptacle 64. A lock pin (not shown) similar to lock pin 70 can be used to mate with one of receptacles 65 or 66 and cooperate with hole 24B in order to rigidly couple an air bearing pontoon to a lower corner of shipping container 100.

The advantages of the present invention are numerous. Large heavy shipping containers (or other equipment) coupled to the air bearing pontoons allow the containers to be maneuvered over solid, soft, water, even and uneven, and prepared and unprepared terrains. The present invention can be adapted to provide great maneuverability in space-restricted environments and in open, unstable environments. Individual control of each air bearing pontoon's inflation pressure allows a shipping container to be steered. Shipping containers supported on such air bearing pontoons can be tethered to one another to form a train. Control of inflation pressure can come from onboard each air bearing pontoon or from some remote location thereby allowing a central control point to maneuver a number of shipping containers from a single location.

Although the invention has been described relative to a specific embodiment thereof, there are numerous variations and modifications that will be readily apparent to those skilled in the art in light of the above teachings. For example, a single air bearing pontoon of the type described herein could be centered underneath a container and coupled to all corner fittings of the container. Further, other methods of coupling each air bearing pontoon to a container's fittings can be used. It is therefore to be understood that, within the scope of the appended claims, the invention may be practiced other than as specifically described.

What is claimed as new and desired to be secured by Letters Patent of the United States is:

1. A system for facilitating movement of a shipping container comprising:

a plurality of air bearing pontoons interposed between a shipping container and a surface, each of said plurality of air bearing pontoons including an inflatable skirt and a controllable air supply coupled to said inflatable skirt for controlling air pressure within said inflatable skirt, wherein said inflatable skirt floats on a cushion of air above the surface; and a plurality of fittings with each fitting being positioned at a lower corner of the shipping container, said fitting having three sides with a first side forming a base positioned at the bottom of the shipping container, said fitting further having second and third sides extending perpendicularly up from said first side with said second and third sides joined to one another to form a 90° angle therebetween, each of said first, second and third sides being provided with a receptacle therein, wherein each of said plurality of air bearing pontoons is coupled to the shipping container using at least one said receptacle from two of said plurality of fittings.

2. A system as in claim 1 wherein the shipping container defines a footprint on the surface, and wherein each of said plurality of air bearing pontoons is coupled underneath the shipping container such that said plurality of air bearing pontoons reside within the footprint of the shipping container.

3. A system as in claim 1 wherein the shipping container defines a footprint on the surface, said system further comprising a plurality of arms coupling each of said plurality of air bearing pontoons to the shipping container such that said plurality of air bearing pontoons reside outside the footprint of the shipping container.

4. A system as in claim 1 wherein said plurality of air bearing pontoons comprises two air bearing pontoons disposed in a substantially parallel relationship to one another along the length of the shipping container.

5. A system as in claim 4 wherein the shipping container defines a footprint on the surface, and wherein each of said two air bearing pontoons is coupled underneath the shipping container such that said two air bearing pontoons reside within the footprint of the shipping container.

6. A system as in claim 4 wherein the shipping container defines a footprint on the surface, said system further comprising a plurality of arms coupling each of said two air bearing pontoons to the shipping container such that said two air bearing pontoons reside outside the footprint of the shipping container.

7. A system as in claim 1 wherein said controllable air supply comprises:

an air pressure source coupled to said inflatable skirt for supplying air pressure thereto;

a vent in said inflatable skirt; and a controller coupled to said air pressure source and said vent for controlling operation of said air pressure source and said vent.

8. A system as in claim 7 wherein said controller is remotely located.

9. A system for facilitating movement of a shipping container over a surface comprising:

a plurality of fittings with each fitting being positioned at a lower corner of a shipping container, said fitting having three sides with a first side forming a base positioned at the bottom of the shipping container, said fitting further having second and third sides extending perpendicularly up from said first side with said second and third sides joined to one another to form a 90° angle therebetween, each of said first, second and third sides being provided with a receptacle therein; and two air bearing pontoons coupled to the shipping container using at least one said receptacle from each of said plurality of fittings, said two air bearing pontoons disposed in a substantially parallel relationship to one another along the length of the shipping container, each of said two air bearing pontoons including an inflatable skirt and a controllable air supply coupled to said inflatable skirt for controlling air pressure within said inflatable skirt, wherein said inflatable skirt floats on a cushion of air above a surface.

10. A system as in claim 9 wherein the shipping container defines a footprint on the surface, and wherein said two air bearing pontoons are coupled to said receptacle on said first side of each of said plurality of fittings such that said two air bearing pontoons reside within the footprint of the shipping container.

11. A system as in claim 9 wherein the shipping container defines a footprint on the surface, said system further comprising a plurality of arms coupling each of said two air bearing pontoons to said receptacle on one of said second and third sides of each of said plurality of fittings such that said two air bearing pontoons reside outside the footprint of the shipping container.

12. A system as in claim 9 wherein said controllable air supply comprises:

an air pressure source coupled to said inflatable skirt for supplying air pressure thereto;

a vent in said inflatable skirt; and a controller coupled to said air pressure source and said vent for controlling operation of said air pressure source and said vent.

13. A system as in claim 12 wherein said controller is remotely located.

14. A system as in claim 9 wherein each of said two air bearing pontoons includes plugs for rigidly coupling each of said two air bearing pontoons to two of said plurality of fittings via said receptacle at one of said first, second and third sides thereof.

15. A system for facilitating movement of a shipping container over a surface comprising:

a plurality of fittings with each fitting being positioned at a lower corner of a shipping container, said fitting having three sides with a first side forming a base positioned at the bottom of the shipping container, said fitting further having second and third sides extending perpendicularly up from said first side with said second and third sides joined to one another to form a 90° angle therebetween, each of said first, second and third sides being provided with a receptacle therein;

two air bearing pontoons coupled to the shipping container via said plurality of fittings, said two air bearing pontoons disposed in a substantially parallel relationship to one another along the length of the shipping container;

each of said two air bearing pontoons including a housing and an inflatable skirt disposed beneath said housing, said housing supporting an air pressure source that is coupled to said inflatable skirt for supplying air pressure to said inflatable skirt wherein said inflatable skirt floats on a cushion of air above a surface;

each said inflatable skirt including a vent therein for venting said air pressure;

a controller coupled to each said air pressure source and each said vent for controlling operation thereof; and means for rigidly coupling each said housing to two of said plurality of fittings via said receptacle at one of said first, second and third sides thereof.

16. A system as in claim 15 wherein the shipping container defines a footprint on the surface, and wherein said means for rigidly coupling cooperates with said receptacle on said first side of each of said plurality of fittings such that said two air bearing pontoons reside within the footprint of the shipping container.

17. A system as in claim 15 wherein the shipping container defines a footprint on the surface, and wherein said means for rigidly coupling cooperates with said receptacle on one of said second and third sides of each of said plurality of fittings such that said two air bearing pontoons reside outside the footprint of the shipping container.

18. A system as in claim 15 wherein said controller is remotely located.

19. A system as in claim 15 wherein each of said plurality of fittings is an ISO standardized fitting.

* * * * *